US008613812B2

(12) United States Patent
Yuan et al.

(10) Patent No.: US 8,613,812 B2
(45) Date of Patent: Dec. 24, 2013

(54) METHOD OF MAKING ZR-RICH AMORPHOUS ALLOY ARTICLE

(75) Inventors: Xiao-Bo Yuan, Shenzhen (CN); Yi-Min Jiang, Shenzhen (CN); Jun-Qi Li, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 249 days.

(21) Appl. No.: 13/236,894

(22) Filed: Sep. 20, 2011

(65) Prior Publication Data

US 2012/0222780 A1 Sep. 6, 2012

(30) Foreign Application Priority Data

Mar. 3, 2011 (CN) ..... 2011 1 0051331

(51) Int. Cl.

| | |
|---|---|
| ***C22B 9/04*** | (2006.01) |
| ***C22C 45/10*** | (2006.01) |
| ***B22D 18/06*** | (2006.01) |
| ***B22D 21/00*** | (2006.01) |

(52) U.S. Cl.
USPC ..... 148/538; 148/561; 164/61; 164/493

(58) Field of Classification Search
USPC ..... 148/538, 561; 164/61, 493
See application file for complete search history.

(56) References Cited

U.S. PATENT DOCUMENTS

| | | | | |
|---|---|---|---|---|
| 5,735,975 | A * | 4/1998 | Lin et al. | 148/403 |
| 6,021,840 | A * | 2/2000 | Colvin | 164/113 |
| 6,521,058 | B1 * | 2/2003 | Inoue et al. | 148/403 |
| 6,682,611 | B2 * | 1/2004 | Zhang et al. | 148/561 |
| 8,333,850 | B2 * | 12/2012 | Gong et al. | 148/538 |
| 2009/0288741 | A1 * | 11/2009 | Zhang et al. | 148/561 |
| 2011/0097237 | A1 * | 4/2011 | Gong et al. | 420/423 |

FOREIGN PATENT DOCUMENTS

| | | | |
|---|---|---|---|
| CN | 101195874 | A | 6/2008 |
| CN | 101619425 | A | 1/2010 |

* cited by examiner

*Primary Examiner* — George Wyszomierski
(74) *Attorney, Agent, or Firm* — Altis Law Group, Inc.

(57) ABSTRACT

A method of making a Zr-rich amorphous alloy article includes providing a Zr-rich master alloy made of an Zr—Cu—Al—Ni—Nb alloy, in which the purity of the raw Zr is substantially in a range of 98% to 99.9%; providing a vacuum induction furnace, and melting the Zr-rich master alloy in the furnace at a temperature in a range of 1100 degrees Celsius to 1200 degrees Celsius; cooling the master alloy to a temperature in a range from 800 degrees Celsius to 900 degrees Celsius in 30 min to 40 min; casting the master alloy into ingots, and then cooling the ingots to a temperature in a range from 200 degrees Celsius to 350 degrees Celsius; and die casting the alloy ingots to obtain Zr-rich amorphous alloy articles with thicknesses in a range of 0.5 mm to 2 mm. A Zr-rich amorphous alloy article made by the above-mentioned method is further provided.

9 Claims, 2 Drawing Sheets

| Thickness (mm) | R0 (MPa) | R1 (MPa) | R2 (MPa) | R3 (MPa) |
|---|---|---|---|---|
| 0.5 | 1557 | 1718 | 1655 | 1800 |
| 1.0 | 2093 | 2174 | 2197 | 2228 |
| 1.5 | 2056 | 2085 | 2046 | 2109 |
| 2.0 | 1916 | 1936 | 1929 | 1985 |

FIG. 2

METHOD OF MAKING ZR-RICH AMORPHOUS ALLOY ARTICLE

BACKGROUND

1. Technical Field

The present disclosure generally relates to amorphous alloy articles and method of making the same, and particularly, to a Zr-rich bulk amorphous alloy article and a method of making the same.

2. Description of Related Art

Since amorphous alloy has a similar structure to glass, it is also called a metallic glass, and provides superior magnetic, mechanical, physical and chemical properties in comparison with crystallized alloys. A Zr-rich amorphous alloy has a relatively wide supercooled liquid region, and makes it easy to form an amorphous state, such that the Zr-rich amorphous alloys may be widely used in engineering and manufacturing. However, Zr raw materials with a high purity (higher than 99.9%) have a relatively high price, and thus the Zr-rich amorphous alloy articles made also have a relatively high price, such that their applications are limited.

Therefore, there is room for improvement within the art.

BRIEF DESCRIPTION OF THE DRAWINGS

FIG. 2 is a table of the results of the bending strength of the samples which have different thicknesses.

DETAILED DESCRIPTION

Figure 1:
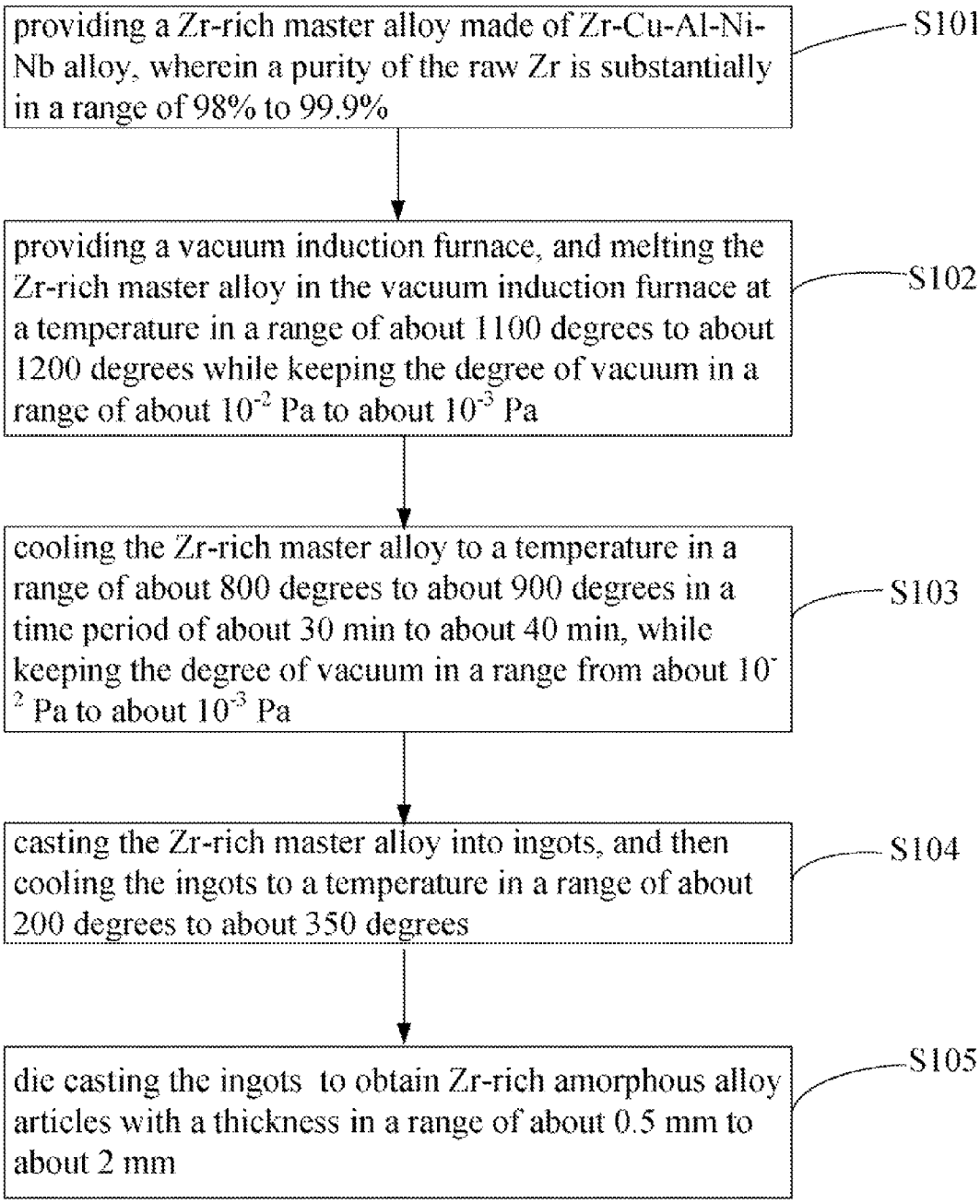
FIG. 1 is a flowchart of a method of making the Zr-rich amorphous alloy article of the illustrated embodiment.

An embodiment of a Zr-rich alloy article is made of a zirconium, copper, aluminum, nickel, and niobium (Zr—Cu—Al—Ni—Nb) alloy, wherein the purity of the Zr raw materials is substantially in a range of 98% to 99.9%. The thickness of the Zr-rich amorphous alloy article is substantially in a range of about 0.5 mm to about 2 mm.

Referring to FIG. 1, a method of making the Zr-rich amorphous alloy article of the embodiment is as follows.

In a first step S101, a Zr-rich master alloy is provided. The Zr-rich master alloy is a Zr—Cu—Al—Ni—Nb alloy, wherein the purity of the raw Zr is substantially in a range of 98% to 99.9%, and the purities of the raw Cu, the raw Al, the raw Ni, and the raw Nb are all substantially greater than 99.9%. The Zr-rich master alloy contains substantially 50-70% by weight (wt %) Zr, 10-15 wt % Cu, 5-10 wt % Al, 5-10 wt % Ni, and 5-20 wt % Nb.

In a second step S102, a vacuum induction furnace is provided, and the Zr-rich master alloy is melted in the vacuum induction furnace at a temperature in a range of about 1,100 degrees Celsius to about 1,200 degrees Celsius. Before it is completely melted, the Zr-rich master alloy is kept heated in the vacuum induction furnace within the said temperature range and a degree of vacuum is applied, in a range of about $10^{-2}$ Pascals (Pa) to about $10^{-3}$ Pa.

In a third step S103, the Zr-rich master alloy is cooled to a temperature within a range of about 800 degrees Celsius to about 900 degrees Celsius in a time period of 30 min to 40 min, while maintaining the vacuum in the same pressure range.

In a fourth step S104, the Zr-rich master alloy is casted into a plurality of ingots, and then the ingots are cooled to within a temperature range of about 200 degrees Celsius to about 350 degrees Celsius, while still maintaining the same degree of vacuum. In the embodiment, the ingot is substantially spherical with a diameter in a range from about 3 cm to about 4 cm, for facilitating the carriage of the ingots when die casting. Ice water can be used to cool the ingots.

In a fifth step S105, the ingots are die casted in a casting mold to obtain a plurality of Zr-rich amorphous alloy articles with thicknesses of about 0.5 mm to about 2 mm. A charge for casting of the ingots is permitted to cool and solidify at a cooling rate sufficiently high to retain the amorphous state in the alloy articles.

A first embodiment of the method of making the Zr-rich amorphous alloy article of the embodiment is as follows.

In a first step, a Zr-rich master alloy is provided. The Zr-rich master alloy is made of Zr—Cu—Al—Ni—Nb alloy, wherein the purity of the raw Zr is substantially in a range of 98% to 99.9%, and the purities of the raw Cu, the raw Al, the raw Ni, and the raw Nb are all substantially greater than 99.9%. The Zr-rich master alloy is represented with a chemical formula $Zr_{57}Al_{10}Cu_{15.4}Ni_{12.6}Nb_5$.

In a second step, a vacuum induction furnace is provided, and then the Zr-rich master alloy is melted in the vacuum induction furnace at a temperature of 1,150 degrees Celsius. Before it is completely melted, the Zr-rich master alloy is kept heated in the vacuum induction furnace at the temperature of 1,150 degrees Celsius, and a vacuum within a range of about $10^{-2}$ Pa to about $10^{-3}$ Pa is applied within the furnace.

In a third step, the Zr-rich master alloy is cooled to a temperature within a range of about 800 degrees Celsius to about 900 degrees Celsius in a time period of about 30 min to about 40 min, while maintaining the vacuum in the same pressure range.

In a fourth step, while keeping the degree of vacuum in the same pressure range, the Zr-rich master alloy is casted into ingots, and then the ingots are cooled to a temperature of 300 degrees Celsius. The ingots are substantially spherical with a diameter of 3 cm.

In a fifth step, the ingots are die casted in a casting mold to obtain a plurality of Zr-rich amorphous alloy articles labeled as R1, with thicknesses of 0.5 mm, 1 mm, 1.5 mm or 2 mm. A charge for casting of the ingots is permitted to cool and solidify at a cooling rate sufficiently high to retain the amorphous state in the alloy articles R1. The Zr-rich amorphous alloy articles R1 all have the same width of 10 mm and the same length of 100 mm.

A second embodiment of the method of making the Zr-rich amorphous alloy article of the embodiment is similar to the first embodiment of a method of making the Zr-rich amorphous alloy article. However, for the second embodiment before the fifth step, the ingots are subjected to one repetition of the second, third, and fourth steps in that order, and then the ingots are die casted in a casting mold to obtain a plurality of Zr-rich amorphous alloy articles labeled as R2, with thicknesses of 0.5 mm, 1 mm, 1.5 mm or 2 mm. A charge for casting of the ingots is permitted to cool and solidify at a cooling rate sufficiently high to retain the amorphous state in the alloy articles R2. The Zr-rich amorphous alloy articles R2 have the same width of 10 mm and the same length of 100 mm.

A third embodiment of the method of making the Zr-rich amorphous alloy article of the embodiment is similar to the first embodiment of the method of making the Zr-rich amorphous alloy article. However, for the third embodiment before the fifth step, the ingots are subjected to two repetitions of the second, third, and fourth steps in that order, and then the ingots are die casted in a casting mold to obtain a plurality of Zr-rich amorphous alloy articles labeled as R3, with thicknesses of 0.5 mm, 1 mm, 1.5 mm or 2 mm. A charge for casting of the ingots is permitted to cool and solidify at a cooling rate sufficiently high to retain the amorphous state in the alloy articles R3. The Zr-rich amorphous alloy articles R3 have the same width of 10 mm and the same length of 100 mm.

A comparison of a plurality of samples made by a method similar to the first embodiment of the method of making the Zr-rich amorphous alloy article is shown. However, the second, third, and fourth steps were omitted, and the Zr-rich master alloy was directly die casted to obtain a plurality of Zr-rich amorphous alloy articles labeled as R0, with thicknesses of 0.5 mm, 1 mm, 1.5 mm or 2 mm. A charge for casting of the Zr-rich master alloy is permitted to cool and solidify at a cooling rate sufficiently high to retain the amorphous state in the alloy articles R0. The Zr-rich amorphous alloy articles R0 all had the same width of 10 mm and the same length of 100 mm.

The flexural strength of the samples R0, R1, R2, and R3 were tested on a universal testing machine. The results are shown in FIG. 2.

As shown in FIG. 2, the flexural strength of the samples R1, R2, or R3 is greater than that of many engineering materials averaged about 800 MPa, and that taking notice of the sample R0 in particular, which shows the second, third, and fourth steps contribute to the flexural strength of the Zr-rich amorphous alloy article. In addition, the relatively impure raw Zr, within a purity range of 98% to 99.9%, can be employed, instead of having to use high-purity raw Zr, greater than 99.9% purity. Thus, the Zr-rich amorphous alloy article has relatively low cost.

It is to be understood, however, that even through numerous characteristics and advantages of the disclosure have been set forth in the foregoing description, together with details of the structure and function of the embodiments, the disclosure is illustrative only, and changes may be made in detail, especially in the matters of shape, size, and arrangement of parts within the principles of the embodiments to the full extent indicated by the broad general meaning of the terms in which the appended claims are expressed.

What is claimed is:

1. A method of making a Zr-rich amorphous alloy article, comprising the steps of:

(a) providing a Zr-rich master alloy made of Zr—Cu—Al—Ni—Nb alloy, wherein said providing a master alloy comprises providing raw Zr having a purity substantially in a range of 98% to 99.9%;

(b) providing a vacuum induction furnace, and melting the Zr-rich master alloy in the vacuum induction furnace at a temperature in a range of about 1100 degrees Celsius to about 1200 degrees Celsius while keeping the degree of vacuum in a range of about $10^{-2}$ Pa to about $10^{-3}$ Pa;

(c) cooling the Zr-rich master alloy to a temperature in a range of about 800 degrees Celsius to about 900 degrees Celsius in a time period of about 30 min to about 40 min, while keeping the degree of vacuum in a range from about $10^{-2}$ Pa to about $10^{-3}$ Pa;

(d) casting the Zr-rich master alloy into a plurality of ingots, and then cooling the ingots to a temperature in a range of about 200 degrees Celsius to about 350 degrees Celsius; and (e) die casting the ingots to obtain the Zr-rich amorphous alloy articles with a thickness in a range of about 0.5 mm to about 2 mm.

2. The method of making the Zr-rich amorphous alloy article of claim 1, wherein the Zr-rich master alloy substantially comprises 50-70 wt % Zr, 10-15 wt % Cu, 5-10 wt % Al, 5-10 wt % Ni, and 5-20 wt % Nb.

3. The method of making the Zr-rich amorphous alloy article of claim 2, wherein the Zr-rich master alloy is represented with a chemical formula $Zr_{57}Al_{10}Cu_{15.4}Ni_{12.6}Nb_5$.

4. The method of making the Zr-rich amorphous alloy article of claim 1, wherein the ingots are substantially spherical with the diameters in a range of about 3 cm to about 4 cm.

5. The method of making the Zr-rich amorphous alloy article of claim 1, wherein before performing the fifth step (e), the ingots are subjected to one repetition of the second (b), third (c), and fourth (d) steps in that order.

6. The method of making the Zr-rich amorphous alloy article of claim 1, wherein before performing the fifth step (e), the ingots are subjected to two repetitions of the second (b), third (c), and fourth (d) steps in that order.

7. The method of making the Zr-rich amorphous alloy article of claim 1, wherein in the fourth step (d), the ingots are cooled to a temperature of 300 degrees Celsius.

8. The method of making the Zr-rich amorphous alloy article of claim 1, wherein thicknesses of the Zr-rich amorphous alloy article are 0.5 mm, 1 mm, 1.5 mm, or 2 mm.

9. The method of making the Zr-rich amorphous alloy article of claim 8, wherein a width of the Zr-rich amorphous alloy article is 10 mm, and a length of the Zr-rich amorphous alloy article is 100 mm.

* * * * *